United States Patent [19]

Rhodes

[11] Patent Number: 4,493,776

[45] Date of Patent: Jan. 15, 1985

[54] LUBRICATING OIL COMPOSITION WITH SUPPLEMENTAL RUST INHIBITOR

[75] Inventor: Robert B. Rhodes, Houston, Tex.

[73] Assignee: Shell Oil Company, Houston, Tex.

[21] Appl. No.: 429,959

[22] Filed: Sep. 30, 1982

[51] Int. Cl.[3] ..... C10M 1/28; C10M 1/54

[52] U.S. Cl. ..... 252/25; 252/52 A; 252/51.5 A

[58] Field of Search ..... 252/25, 52 A, 51.5 A, 252/49.7

[56] References Cited

U.S. PATENT DOCUMENTS 3,784,474 1/1974 Brown et al. ..... 252/25

3,933,662 1/1976 Lowe ..... 252/52 A

*Primary Examiner*—Jacqueline V. Howard

[57] ABSTRACT

A lubricating oil composition for internal combustion engines having superior rust and corrosion inhibition is disclosed. The composition comprises a major amount of a hydrocarbon oil of lubricating viscosity and a minor amount of conventional additives, including an overbased detergent (such as calcium carbonate or calcium hydroxide) for rust protection and an ashless dispersant (such as the reaction product of substituted succinic acid or anhydrides with amines). The composition also includes a supplemental rust inhibitor (SRI) additive which is a combination of an effective amount of a supplemental rust inhibitor (SRI) additive comprising a combination of (A) $R_1O[C_2H_4O]_xH$ and/or $R_2O[C_3H_6O]_yH$ with (B) $R_3O[C_2H_4O]_x[C_3H_6O]_yH$ and/or $R_4O[C_3H_6O]_y[C_2H_4O]_xH$, wherein $R_1$, $R_2$, $R_3$ and $R_4$ are hydrocarbyl radicals selected from alkyl, aryl, alkaryl, and arylalkyl groups or combinations thereof having from about 10 to about 24 carbon atoms; and wherein x and y may vary independently in the range from 3 to about 15.

8 Claims, 1 Drawing Figure

CNRT RESULTS FOR 0.4% WT. $R_1O[EO]_xH$ IN BASE BLEND A

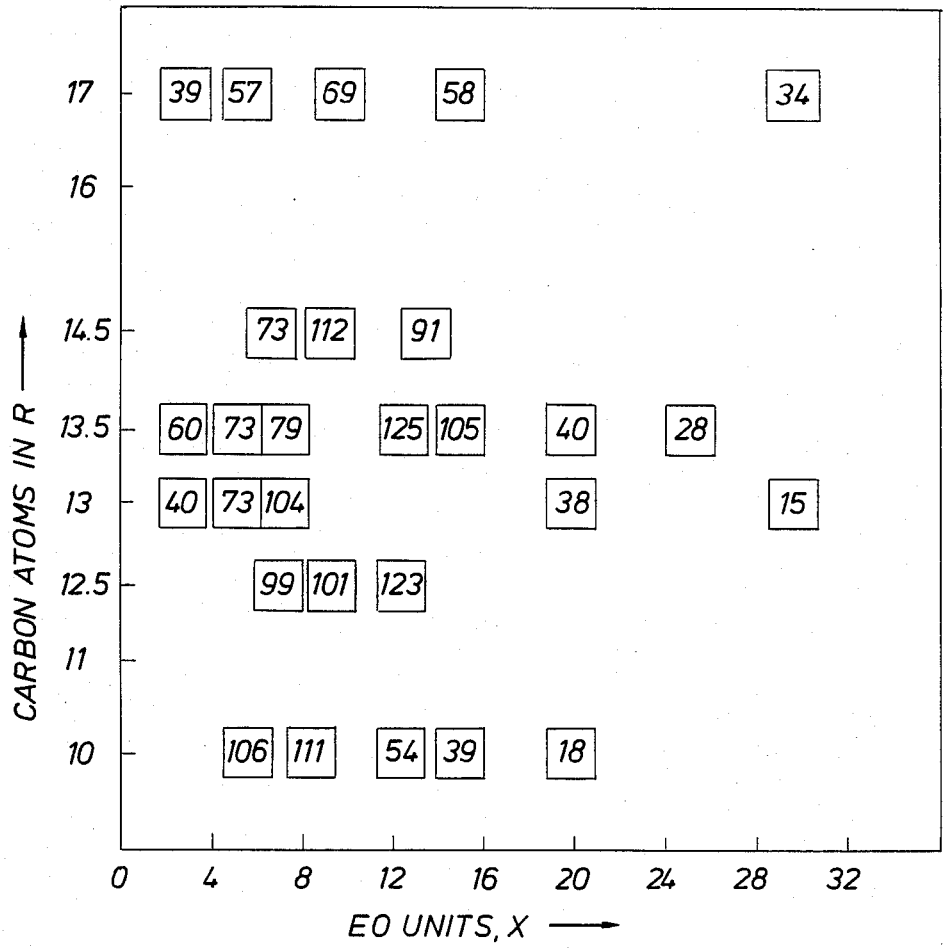
FIG. 1 CNRT RESULTS FOR 0.4% WT. $R_1O[EO]_xH$ IN BASE BLEND A

LUBRICATING OIL COMPOSITION WITH SUPPLEMENTAL RUST INHIBITOR

BACKGROUND OF THE INVENTION

This invention relates to an improved lubricating oil composition for internal combustion engines. Specifically, the invention relates to a lubricating oil composition containing an effective supplemental rust inhibitor (SRI).

Fully-formulated engine lubricants contain overbased detergents which impede engine rust formation by neutralizing the acidic components that are entrapped in the engine sump during fuel combustion. If a lubricant provides insufficient rust protection, more overbased detergent can be added to increase the neutralization reaction rate and thereby decrease the steady-state concentration of acidic components present in the oil. However, cost/performance restraints or sulfated ash restrictions limit the feasibility of this approach. When this occurs, anti-rust "fixes" must be employed or the additive package must be substantially altered.

Anti-rust "fixes" are usually non-ionic surfactants which can be used at relatively low concentrations. Although these materials generally have little or no anti-rust activity by themselves, when they are combined with overbased detergents rust inhibition is sometimes greatly improved. Unfortunately, there are few recognized supplemental rust inhibitors. Three such known SRI's which have been used either commercially or in experimental oils are Plexol 305, Pluronic L-101 and Tetronic 1501. Plexol 305 is an ethoxylated isooctylphenol and is available commercially from Rohm & Haas. Pluronic L-101 is a block polymer based on ethylene oxide and propylene oxide and is available from BASF-Wyandotte. Tetronic 1501 is a tetrapoly(oxyethylene)poly(oxypropylene) derivative of ethylene diamine which is available from BASF-Wyandotte.

Experience has shown that Pluronic L-101 has caused abnormal sludging problems in the field while the use of Tetronic 1501 can result in eventual precipitation of lubricant additive components. These materials are claimed as SRI's in U.S. Pat. Nos. 3,509,052 and 3,928,219, which are incorporated herein by reference.

Although Plexol 305 does not cause sludging problems or precipitation of lubricant additive components, unfortunately it has only modest anti-rust activity. Accordingly, it is an object of this invention to provide an additive which not only overcomes the sludging problems and precipitation problems of known SRI's but which also has good anti-rust activity.

DESCRIPTION OF THE PRIOR ART

In U.S. Pat. No. 3,711,406 poly(hydroxyalkylated) alkyl-substituted amines in combination with alkaline earth metal carbonates were dispersed in a hydrocarbon lubricating oil medium to provide rust protection, corrosion protection and acid neutralization.

A lubricating oil composition containing a hydrocarbyl substituted amine ashless detergent, a polyoxyalkylene derivative, and an alkaline earth metal carbonate dispersed in the oil is described in U.S. Pat. No. 3,784,474. These compositions were found to be highly rust and corrosion inhibitory while also possessing the ability to reduce or prevent the formation of varnish, sludge and deposits on the inner metallic surfaces of internal combustion engines.

Polyoxyalkylene glycols and their reaction products with organic diisocyanate and dicarboxylic acid were combined with alkaline earth metal carbonates dispersed in a hydrocarbon medium to provide acid neutralization capability and rust inhibition in lubricating compositions, as described in U.S. Pat. No. 3,791,971. A companion case, U.S. Pat. No. 3,856,687, describes a combination of an imidazoline polyalkoxylated compound and an alkaline earth metal carbonate dispersed with a sulfonate or phenate compound in an oil of lubricating viscosity to provide rust and corrosion protection.

In U.S. Pat. No. 3,844,965 the reaction product of a $C_{30}$–$C_{200}$ hydrocarbyl substituted amine, amide or cyclic imide lubricating oil ashless dispersant, with an organic polyisocyanate and a polyoxyalkalene polyol, functions as a lubricating oil additive for inhibiting engine rust.

The above-mentioned five prior art patents are incorporated herein by reference.

SUMMARY OF THE INVENTION

A crankcase lubricating oil composition for internal combustion engines which has superior rust and corrosion inhibition is provided which, in addition to a major amount of a hydrocarbon oil of lubricating viscosity and a minor amount of conventional additives including at least one overbased detergent additive for rust protection and at least one ashless dispersant, includes an effective amount of a supplemental rust inhibitor (SRI) additive comprising a combination of (A) $R_1O[C_2H_4O]_xH$ and/or $R_2O\ [C_3H_6O]_yH$ with (B) $R_3O[C_2H_4O]_x[C_3H_6O]_yH$ and/or $R_4O[C_3H_6O]_y[C_2H_4O]_xH$, wherein $R_1$, $R_2$, $R_3$ and $R_4$ are hydrocarbyl radicals selected from alkyl, aryl, alkaryl, and arylalkyl groups or combinations thereof having from about 10 to about 24 carbon atoms; and wherein x and y may vary independently in the range from 3 to about 15.

FIG. 1 is a plot of CNRT results for Type (A) components ($R_1O[EO]_xH$) at various values of R and x.

DETAILED DESCRIPTION

The greatest impediment to the development of SRI's has been the unavailability of reliable bench screening tests. The high cost of engine tests preclude their utilization for extensive SRI optimization. Accordingly, three screening tests were used to determine the effectiveness of the combination SRI additive of the invention.

The Sequence tests were developed to evaluate selected engine oil performance characteristics such as rust and corrosion, some types of wear, high-temperature sludge and varnish deposits, rumble, oil-thickening and oil consumption. These Engine Oil Tests are summarized in the 1981 SAE Handbook, Engine Oil Tests—SAE J304c. These tests were never intended to replace field testing completely, nor were they developed to be the only tests which oils should pass before they were marketed.

The Sequence IIC test was developed to provide a better evaluation of the rust protection afforded by the higher quality SE oils. This test, which provides an acceptable correlation with short-trip field rust results, is described in SAE Paper 730779 by Richard H. Kabel, "The Sequence IIC Rust Test Procedure", presented at a symposium in Milwaukee, Wis., Sept. 10–13, 1973, and which is incorporated herein by reference.

Two laboratory tests were also used to screen SRI additives. The Constant pH Neutralization Rust Test (CNRT) was developed to measure acid neutralization rates of lubricants which contain overbased detergent/-SRI combinations in a primarily aqueous environment. Good anti-rust activity usually corresponds to high meq/gm readings provided the Water-in-Oil Emulsion Test (WOET) ratings (infra) are 3 to 5. However, a poor CNRT result, i.e., low meq acid/gm is expected to give a poor engine test result, regardless of the WOET rating. What may be considered to be good response in the CNRT will depend upon the oil formulation used to evaluate SRI candidates. To define an acceptable CNRT value, oils must be tested in both the CNRT and the Sequence IIC test.

In a working engine, water is present in very low concentration. If neutralization is occurring at the oil/-water interface, then rust inhibition should be favored by dispersal of water into small droplets, thus increasing the total interfacial surface area. From a study of lubricants which had previously been evaluated in the Sequence IIC engine rust test, it was observed that good Sequence IIC performance corresponds to rapid CNRT neutralization rates and dispersion of water into small droplets in oil.

The WOET provides a qualitative method of screening surfactant additives for their rust inhibiting properties. This method rates the relative turbidity of oil blends after being stirred with a small amount of water. Turbidity is used as an indication of the ability of an oil blend to suspend aqueous contaminants, thus exposing free acids more readily to basic components in the oil. Neutralization of these free acids should inhibit rust formation.

Using the droplet dispersion (WOET) procedure and the CNRT, a number of non-ionic surfactants were evaluated as SRI additives. Surprisingly, we found that NEODOL® 25-6PO, which is a non-ionic surfactant with mild anti-rust activity in engine lubricants, and PLURAFAC® RA-40, which is available commercially from BASF-Wyandotte and is a prorust agent, may be combined to provide an excellent SRI for engine lubricants. The Sequence IIC engine rust test, the CNRT and WOET all support this finding.

NEODOL® 25-6PO is a mixture of dodecylpenta(oxypropylene) propanol to pentadecylpenta(oxypropylene) propanol, i.e., $C_{12-15}O[PO]_6H$, where PO equals $C_3H_6O$. It is not available commercially but can be prepared by reacting Neodol® 25 (Shell Chemical Company) with propylene oxide.

The preparation of Neodol® 25-6PO (or Neodol® 25-6EO) is readily accomplished by condensing propylene oxide (or ethylene oxide) with Neodol® alcohol using a basic material such as potassium hydroxide to effect the condensation reaction. This is followed by neutralization of the resultant alkoxide salt with an acetic acid wash. The Neodol® 25 and the propylene oxide ratio must be controlled in order to effect the appropriate number of PO (or EO) units.

In addition, $R_3O[EO]_x[PO]_yH$ or $R_4O[PO]_y[EO]_xH$ can be prepared similarly, except that ethylene oxide (or propylene oxide) is first reacted with the alcohol; then, when the ethylene oxide (or propylene oxide) is reacted, propylene oxide (or ethylene oxide) is reacted before the acid wash step.

PLURAFAC® RA-40 is a mixture of $C_{12}$–$C_{15}$ $O[EO]_{4-5}[PO]_{4-5}H$, where EO equals $C_2H_6O$, and may be designated as dodecyl to pentadecyl tetra(oxyethylene)tetra(oxypropylene) propanol.

An effective amount of the combination of additives of the invention in lubricating oil will range from about 0.2 to about 1.5% wt of the oil composition. The upper concentration limit is set by economics since more than about 1.5% wt of the additive will not provide additional SRI protection. Preferably the total SRI content will be in the range from about 0.3 to about 1.0% wt of the oil. The individual SRI additive component (A) may vary from about 0.05 to about 1% wt and component (B) may vary from about 0.2 to about 1.5% wt, of the lubricating oil composition.

In the SRI component (A) with the structure $R_1O[C_2H_4O]_xH$ and/or $R_2O[C_3H_6O]_yH$, $R_1$ and $R_2$ are hydrocarbyl radicals which may be either alkyl, aryl, alkaryl or arylalkyl groups having from about 10 to about 24 carbon atoms. Preferably, the hydrocarbyl radical will be alkyl and will have from about 10 to about 15 carbon atoms. It is anticipated that x and y may vary from 3 to about 15, although values from about 3 to about 8 are especially suitable.

Although the Type A component $R_1O[C_2H_4O]_yH$ was not tested, it is believed that it can be made to work with Type B materials--just as $R_3O[EO]_x[PO]_yH$ and $R_4O[PO]_y[EO]_xH$ are interchangeable for Type B materials. For any given $R_2O[C_3H_6O]_yH$, depending on the y value, there will be an optimum Type B material, which will depend on the EO/PO ratio. That is, for a specific component $R_2O[PO]_yH$, there will be an optimum structure, say $R_3O[EO]_x[PO]_yH$ that will depend on the EO/PO ratio. For a specific component $R_1O[EO]_yH$, there will also be an optimum structure, $R_3O[EO]_x[PO]_yH$ or $R_4O[PO]_y[EO]_xH$ that will also depend on the EO/PO ratio; in this case, however, the EO/PO ratio can be expected to be lower than if $R_2O[-PO]_yH$ were used, since there is relatively more PO in the (B) component. The optimum ratio can be readily determined by making a series of tests for each Type A and Type B combination chosen.

The component $R_1O[EO]_xH$ is not especially suitable as a Type (B) compound. Although this material gives good CNRT values by itself, it has been observed that the WOET ratings are low and cannot be sufficiently improved by the addition of the Type A material, $R_2O[-PO]_yH$.

In the SRI component (B) with the structure $R_3O-[EO]_x[PO]_yH$ and/or $R_4O[PO]_y[EO]_xH$, $R_3$ and $R_4$ may be selected independently from the same type compounds set out above for $R_1$. Also, x and y may vary independently from 3 to about 15, with values of 3 to about 8 being especially suitable.

Although the reverse compound, i.e., $R_4O[-PO]_y[EO]_xH$ was not tested as a component of the SRI additive, it is believed that such compounds would function in the same manner as $R_3O[EO]_x[PO]_yH$ compounds. Furthermore, combinations of the two types of (B) additives should also provide a suitable component for the combination SRI additive of the invention.

It is a requirement of the invention that the lubricating oil composition contain an overbased detergent additive as the primary rust inhibitor. These additives are well known in the art and may suitably be selected from alkaline earth carbonates and hydroxides. It is also a requirement of the invention that the oil composition contain at least one ashless dispersant. These additives are also well known in the art and may suitably be selected from the reaction products of substituted succinic acid or anhydrides with amines.

The invention will now be further clarified by a consideration of the following examples, which are intended to illustrate the invention and are not to be regarded as a limitation thereof.

TABLE 1

| BASE BLEND A TEST RESULTS | | | | | |
|---|---|---|---|---|---|
| Sample No. | SRI | % wt in Oil | Water-In-Oil Emulsion Test Rating | CNRT meq/gm | Average IIC Rust Rating |
| 1 | Plurafac ® RA-40 | 0.40 | 3 | 98 | 4.9 |
| 2 | Neodol ® 25-12 | 0.40 | 1 | 125 | 5.3 |
| 3 | None | — | 1 | 9 | 5.9 |
| 4 | Pluronic ® L-101 | 0.20 | 2 | 102 | 7.6 |
| 5 | Tetronic ® 1501 | 0.10 | 3 | 77 | 8.7 |
| 6 | Pluronic ® L-101 | 0.20 | 4 | 106 | 8.7 |
| | Plexol ® 305 | 0.20 | | | |

TABLE 2

| BASE BLEND B TEST RESULTS | | | | | |
|---|---|---|---|---|---|
| Sample No. | SRI | % wt in Oil | Water-In-Oil Emulsion Test Rating | CNRT meq/gm | Average IIC Rust Rating |
| 7 | None | — | 1 | Could not test[a] | Did not test |
| 8 | Neodol ® 25-6PO[b] | 0.25 | 2 | 30 | 7.5 |
| 9 | Plexol ® 305 | 0.30 | 3 | 35 | 7.6 |
| 10 | Plexol ® 305 | 0.20 | 4 | 46 | 8.4 |
| | Pluronic ® L-101 | 0.05 | | | |
| 11 | Plurafac ® RA-40 | 0.60 | 4 | 48 | 8.4 |
| | Neodol ® 25-6PO | 0.20 | | | |

[a]Value too low to measure.
[b]Prepared by Emery Industries for Shell Development Company.

EXAMPLE I

Two lubricating oil test blends were prepared to determine the effectiveness of supplemental rust inhibitors. Base Blend A (Sample 3, Table 1) contained calcium carbonate/hydroxide overbased alkyl salicylate and calcium alkyl sulfonate detergents; alkyl succinimide amine dispersant; zinc dialkyldithiophosphate antiwear agents; a styrene/diene-type VI improver; and base oil. This additive system provided an SAE 10W-30 Grade oil that did not meet the SE quality rust protective requirement of an 8.4 average min. rating in the Sequence IIC Engine Rust test (see Sample No. 3, Table 1). SE performance qualifications are defined in SAE Engine Oil Performance and Engine Service Classification SAE J183, Feb. 80. Base Blend A only gave a 9 meq/gm response in the CNRT: A good response from a suitable SRI additive should increase the test result for this blend to at least 70 meq.

Base Blend B (Sample 7, Table 2) contained a calcium carbonate/hydroxide overbased alkylsalicylate; a calcium alkylsulfonate; a polyisobutylene succinimide dispersant; a polyisobutylene maleic anhydride ester dispersant; zinc dialKyldithiophosphate antiwear additives; and base oil. This additive system is representative of one that could be used to obtain passing SE performance, except for antirust performance in the Sequence IIC Engine test where the incorporation of 0.3% weight of the SRI additive Plexol 305 (see Sample No. 9, Table 2) did not provide the necessary 8.4 min. rating requirement. All test oils made with Base Blend B conformed to SAE 30 grade oils (according to the SAE Viscosity Classification System J300).

The response of SRI additives in Base Blend B was much lower than in Base Blend A as measured in the CNRT. For Base Blend B, an SRI candidate which improved the CNRT rating to 40 meq. or greater was considered to be a promising candidate. However, the selection of the best SRI's for use in Base Blend B depended on finding an SRI which gave a relatively high meq./gm rating in the CNRT and a 3–5 (preferably 4–5) rating in the WOET. This is apparent from the results in Table 2.

EXAMPLE II

The CNRT test requires an automatic titrator (e.g., a Mettler automatic titrator); a temperature controller (e.g., an $I^2R$ "Thermowatch" connected to a hot plate); an overhead mechanical stirrer (two blades); glass and calomel reference electrodes; a 300 ml beaker; and a strip chart recorder (span −0.1–1 volt). During the test, the automatic titrator is set for "ph-stat" operation. 150 ml of water is placed in the 300 ml beaker. The water is stirred at 300 rpm and the water temperature is raised to 38° C.±1°. 20 g of oil is slowly poured into the beaker (test cell) at this time. The recorder is started and the auto titrator is brought into operation. The recorder plots HCl added versus time. The automatic titrator will be set so that 0.1 Normal HCl is added at a rate needed to maintain the acidity at 4.5 pH.

For recording purposes, at 4.5 pH, at 15 minutes test time, the rating is equal to $$\frac{\text{meq HCl added} \times 10^3}{\text{grams oil}}.$$

Using the CNRT procedure, a number of non-ionic surfactant combinations were evaluated for their ability to improve acid neutralization rates of Base Blend A. These materials, which included SRI's with the structure $R_3O[EO]_x[PO]_yH$ are listed in Table 3. Note that increasing the ratio of EO to PO units tended to improve the CNRT rating. One candidate surfactant, Plurafac RA-40 was evaluated at 0.4% weight in Base Blend A in the Sequence IIC Engine Test. The oil with Plurafac RA-40 failed the test, giving a rating of only 4.9. (See Sample No. 1, Table 1).

EXAMPLE III

Using the CNRT procedure, another series of non-ionic surfactants was evaluated in Base Blend A. These materials, which include SRI's with the structure $R_4O[PO]_y[EO]_xH$ are listed in Table 4. These materials also showed promise as SRI's. It appears from the CNRT results of Tables 3 and 4 that the location of the PO or EO blocks relative to the RO unit has little, if any effect on CNRT response.

TABLE 3

$R_3O[EO]_x[PO]_yH$ CNRT PERFORMANCE IN BASE BLEND A

| Sample No. | SRI[a] | R | x Avg EO/mole | y Avg PO/mole | CNRT meq/1000 g at 15 min |
|---|---|---|---|---|---|
| 12 | NEODOL ® 25-6PO[b] | $C_{12}$–$C_{13}$ | 0 | 6 | 34.8 |
| 13 | NEODOL ® 23-4EO4PO[b] | $C_{12}$–$C_{13}$ | 4 | 4 | 83.3 |
| 14 | Plurafac ® RA-40 | $C_{12}$–$C_{15}$ | 4.3 | 4.9 | 94.0 |
| 15 | Plurafac ® RA-43 | $C_{12}$–$C_{15}$ | 4.3 | 4.9 | 96.6 |
| 16 | Plurafac ® RA-50 | — | — | — | 90.4 |
| 17 | Plurafac ® D-25 | $C_{12}$–$C_{15}$ | 11.7 | 6.1 | 124 |
| 18 | Plurafac ® B-26 | $C_{12}$–$C_{15}$ | 16.3 | 4.0 | 126[c] |
| 19 | Plurafac ® RA-20 | | | | 105 |

[a]All at 0.4% w in Base Blend A.
[b]Not available commercially; made from Neodol ® alcohol shown.
[c]Reached this value in eight minutes test time.

TABLE 4

$R_4O(PO)y(EO)xH$ CNRT PERFORMANCE IN BASE BLEND A

| Sample No. | SRI | R | y | x | CNRT meq/1000 g at 15 min |
|---|---|---|---|---|---|
| 20 | NEODOL ® 01-3PO3EO[b] | $C_{10}$–$C_{11}$ | 3 | 3 | 74.8 |
| 21 | NEODOL 01-3PO12EO[b] | $C_{10}$–$C_{11}$ | 3 | 12 | 83.4 |
| 22 | NEODOL 01-9PO3EO[b] | $C_{10}$–$C_{11}$ | 9 | 3 | 63.8 |
| 23 | NEODOL 01-9PO12EO[b] | $C_{10}$–$C_{11}$ | 9 | 12 | 122 |
| 24 | Dobanol ® 91-9PO12EO[c] | $C_9$–$C_{11}$ | 9 | 12 | 122 |

[a]All at 0.4% w in Base Blend A.
[b]Not available commercially; made from Neodol ® alcohol shown.
[c]Available from Shell International Chemical Company.

EXAMPLE IV

A series of SRI candidates having the structure $R_1O[EO]_xH$ were evaluated in Base Blend A. In this study both the alkyl chain length R and the ethoxylate (EO) chain were varied to define CNRT performance. The results of these tests are reported in FIG. 1, where the numbers in the squares are the meq. of 0.1N HCl required to maintain the pH of the oil sample at 4.5.

Note that variation of the average number of carbon atoms in the alkyl chain from 10 to 17 generally produced good 4.5 pH CNRT values of about 70 or greater provided the number of $—CH_2CH_2O—$ (i.e., EO) units was from 4 to 16.

One SRI candidate, Neodol ® 25-12 was selected from this group. This material contained molecules having RO units with alkyl chains having between 12 and 15 carbon atoms and approximately 12 $CH_2CH_2O$ units. At 0.4% wt in Blend A, however, the additive failed to give a passing Sequence IIC engine rust rating; the Water-In-Oil Emulsion Test Rating was also very low (see Sample No. 2, Table 1).

EXAMPLE V

In the WOET, 5 milliliters of the test lubricating oil are placed in a small glass cylindrical vial ($1\frac{5}{8}'' \times \frac{5}{8}''$ I.D.) followed by the addition of 10 microliters of water. The oil/water mixture is then stirred at 400 rpm for 1 hour after stirring. The vial is placed over a glass plate which has a series of black lines approximately 2 mm wide. The glass plate is illuminated by a high intensity light. The lubricating oils are then rated according to the following scale:

1-clean; 2-slightly turbid (lines seen in detail); 3-turbid (lines can be seen and counted, but not in detail); 4-almost translucent (lines seen faintly); 5-translucent (lines not seen). Although this test is not very selective a suitable rating should be at least 3.

A series of tests was made wherein various combinations of Plurafac ® RA-40 and Neodol ® 25-6PO were incorporated into Base Blend B and WOET ratings were determined. The results of these tests are given in Table 5.

TABLE 5

COMBINATION ADDITIVE WATER-IN-OIL EMULSION TEST RATINGS IN BASE BLEND B

| Test No. | Plurafac ® RA-40 % w | Neodol ® 25-6PO[a] % w | Water-In-Oil Emulsion Test Rating |
|---|---|---|---|
| 1 | 0.0 | 0.25 | 2 |
| 2 | 0.4 | 0.0 | 3 |
| 3 | 1.0 | 0.0 | 3 |
| 4 | 0.6 | 0.2 | 4 (2 tests) |
| 5 | 0.6 | 0.05 | 3 |
| 6 | 0.4 | 0.25 | 3 |
| 7 | 0.3 | 0.1 | 3 |
| 8 | 0.2 | 0.05 | 3 |
| 9 | 0.2 | 0.25 | 3 (2 tests) |
| 10 | 0.2 | 1.00 | 3 |

[a]Not available commercially; made from propylene oxide and Neodol ® 25 alcohol.

EXAMPLE VI

The Sequence IIC rust test performance of various SRI additives was also evaluated. In the Sequence IIC rust test a rating of 10.0 is equivalent to no rust formation. For SE qualification, a rating of 8.4 (minimum) is required. Results of the average Sequence IIC ratings for PLURAFAC ® RA-40, Tetronic ® 1501, and a combination of Pluronic ® L-101 and Plexol ® 305 in Base Blend A are given in Table 1.

Samples No. 1 and 2 indicate that PLURAFAC ® RA-40 and Neodol ® 25-12 are pro-rust additives since the average Sequence IIC rust rating is lower than that of the base oil. Good results were obtained with Tetronic® 1501 and the combination of Pluronic® L-101 and Plexol® 305. However, Pluronic® L-101 alone did not meet the minimum rating of 8.4.

A second series of Sequence IIC rust test performance ratings was performed using Base Blend B and various SRI additives, including the SRI additive combination of the invention. These results are shown in Table 2.

Table 2 shows that Plexol® 305 alone (Sample No. 9) fails to meet a minimum rating of 8.4 while the combination of Plexol® 305 and Pluronic® L-101 (Sample No. 10) meets the minimum rating. When NEODOL® 25-6PO is used alone (Sample No. 8) it also fails to meet the minimum rating. However, when PLURAFAC® RA-40 and NEODOL® 25-6PO (Sample No. 11) are combined, a passing Sequence IIC rust rating is achieved.

Other embodiments of the invention will be apparent to those skilled in the art from a consideration of this specification or practice of the invention disclosed herein. It is intended that the specification and examples be considered as exemplary only with the true scope and spirit of the invention being indicated bY the following claims.

What is claimed is:

1. A lubricating oil composition for internal combustion engines comprising:

a major amount of a hydrocarbon oil of lubricating viscosity and a minor amount of conventional additives, including at least one overbased detergent additive for rust protection and at least one ashless dispersant, and an effective amount of a supplemental rust inhibitor containing at least one compound selected from each of the groups consisting of (A) $R_1O[C_2H_4O]_xH$ and $R_2O[C_3H_6O]_yH$ with (B) $R_3O[C_2H_4O]_x[C_3H_6O]_yH$ and $R_4O[C_3H_6O]_y[C_2H_4O]_xH$, wherein $R_1$, $R_2$, $R_3$ and $R_4$ are hydrocarbyl radicals selected from alkyl, aryl, alkaryl, and arylalkyl groups or combinations thereof having from about 10 to 15 carbon atoms and wherein x and y may vary independently in the range from 3 to 8.

2. The lubricating oil composition of claim 1 wherein the overbased detergent additive is selected from alkaline earth carbonates and hydroxides.

3. The lubricating oil composition of claim 2 wherein the overbased detergent additive comprises calcium carbonate and/or calcium hydroxide and the ashless dispersant comprises the reaction product of substituted succinic acid or anhydrides with amines.

4. The lubricating oil composition of claim 1 wherein the SRI additive component (A) is selected from dodecyl penta(oxypropylene) propanol to pentadecyl penta(oxypropylene) propanol.

5. The lubricating oil of claim 1 wherein the SRI additive component (B) is a mixture of dodecyl to pentadecyl tetra(oxyethylene)tetra(oxypropylene) propanol.

6. The lubricating oil of claim 1 wherein the SRI additive component (B) is a mixture of dodecyl to pentadecyltetra(oxypropylene)tetra(oxyethylene) propanol.

7. The lubricating oil composition of claim 1 wherein the SRI additive component (A) consists of from about 0.05 to about 1% wt and component (B) consists of from about 0.2 to about 1.5% wt, of the lubricating oil composition.

8. An improved method of operating internal combustion engines to inhibit rust formation which comprises lubricating said engine with an oil comprising:

a major amount of a hydrocarbon oil of lubricating viscosity and a minor amount of conventional additives, including at least one overbased detergent additive for rust protection and at least one ashless dispersant, and an effective amount of a supplemental rust inhibitor containing at least one compound selected from each of the groups consisting of (A) $R_1O[C_2H_4O]_xH$ and $R_2O[C_3H_6O]_yH$ with (B) $R_3O[C_2H_4O]_x[C_3H_6O]_yH$ and $R_4O[C_3H_6O]_y[C_2H_4O]_xH$, wherein $R_1$, $R_2$, $R_3$ and $R_4$ are hydrocarbyl radicals selected from alkyl, aryl, alkaryl, and arylalkyl groups or combinations thereof having from about 10 to 15 carbon atoms and wherein x and y may vary independently in the range from 3 to 8.

* * * * *